United States Patent [19]

Karalius

[11] 4,188,959

[45] Feb. 19, 1980

[54] PIPE CLEANER

[76] Inventor: Edward J. Karalius, 18158 Hartland St., Reseda, Calif. 91335

[21] Appl. No.: 838,240

[22] Filed: Sep. 30, 1977

[51] Int. Cl.[2] ..... A24F 9/06; A24F 9/10

[52] U.S. Cl. ..... 131/245; 131/246

[58] Field of Search ..... 131/245, 243, 246

[56] References Cited

U.S. PATENT DOCUMENTS

| | | | |
|---|---|---|---|
| 1,527,845 | 2/1925 | Daniel | 132/89 |
| 2,080,738 | 7/1937 | Possinger | 131/246 |
| 2,586,877 | 2/1952 | Spiewak | 131/243 X |

FOREIGN PATENT DOCUMENTS

| | | | |
|---|---|---|---|
| 35070 | 10/1885 | Fed. Rep. of Germany | 131/245 |
| 179784 | 5/1922 | United Kingdom | 131/245 |
| 205633 | 10/1923 | United Kingdom | 131/245 |

*Primary Examiner*—Stephen C. Pellegrino

*Attorney, Agent, or Firm*—Jack C. Munro

[57] ABSTRACT

A bendable resilient, substantially rigid pipe cleaner which is constructed of an elongated member having a fore end and an aft end located on either side of the handle section. Both the fore end and the aft end are tapered to decrease in width toward the outer end of each end. The pipe cleaner is formed in a substantially S-shape with each end of the device being essentially similar.

2 Claims, 4 Drawing Figures

10
12
14
16
18
20
22
24
3

PIPE CLEANER

BACKGROUND OF THE INVENTION

The field of this invention relates to cleaning devices, and more particularly to a cleaning device for a smoking pipe.

It is well known that in the smoking of pipes, the pipe tends to collect debris usually in the form of tobacco residue and saliva. The normal type of cleaning device for such pipe is a bendable length of wire upon which has been wound a soft absorbent material, usually cotton. This type of a pipe cleaner works fine to remove the loose debris, but as far as scale attached to the side wall of the openings within the pipe, such a pipe cleaner will be ineffectual against scale. The scale occurs after a period of time, and in some instances will eventually completely clog the pipe or make the pipe so that it draws poorly, by reducing the dimensions of the side walls of the openings within the pipe.

There is a need for a pipe cleaner which is constructed of a rigid material, but which is to be bendable to assume various configurations so as to facilitate the removing of scale from the various shaped bowls of pipes, as well as through the various shaped smoke drawing orifices of the pipe stem whether such be straight or curved.

SUMMARY OF THE INVENTION

The structure of this invention is believed to be summarily described in the Abstract Of The Disclosure and reference is to be had thereto. The primary objective of this invention is to construct a rigid but bendable pipe cleaning device to facilitate the removing of accumulated scale within the interior of various shaped pipe bowls and the pipe stems.

DETAILED DESCRIPTION OF THE SHOWN EMBODIMENT

Figures 1, 2, 3, 4:
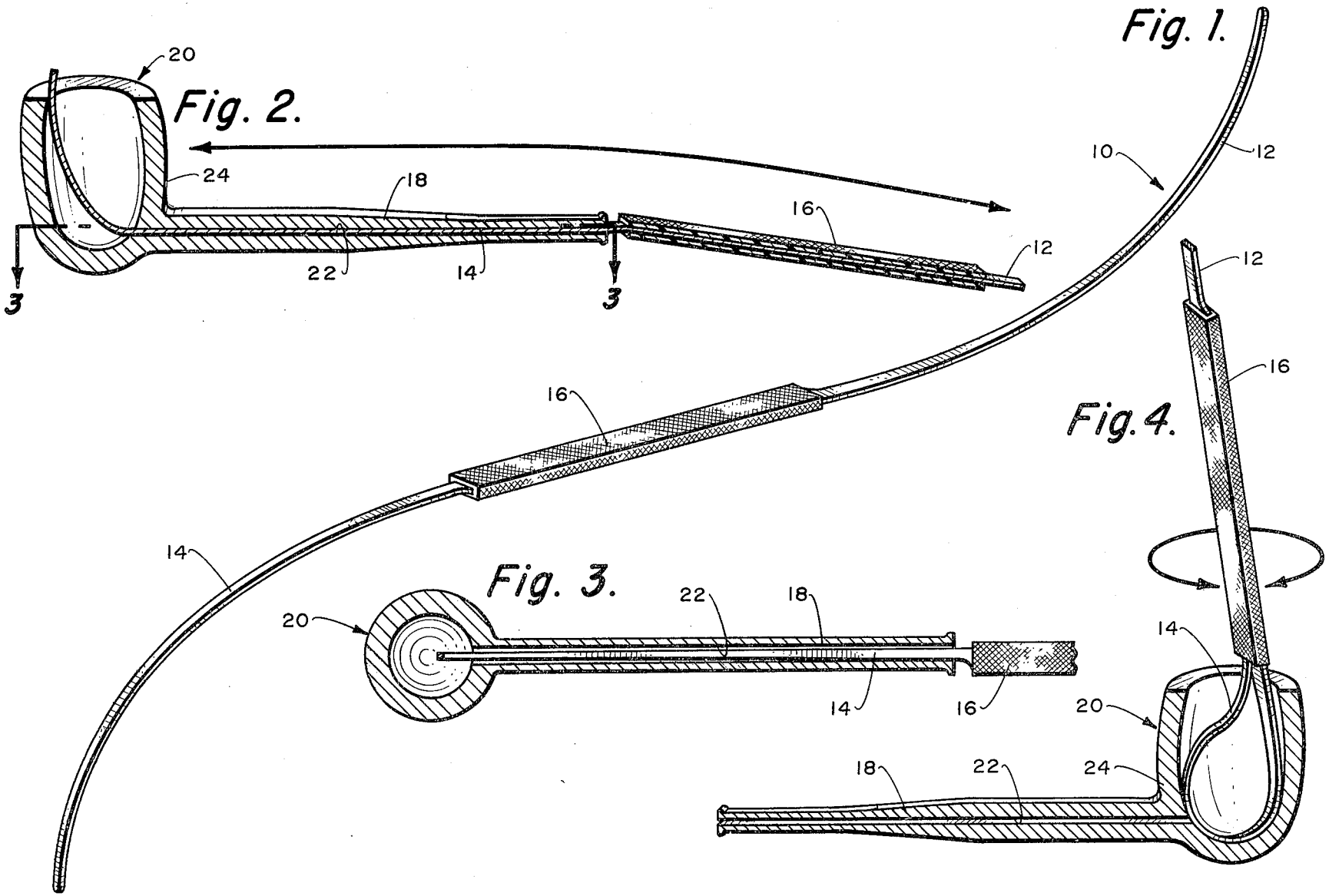
FIG. 1 is an isometric view of the pipe cleaner of this invention.
FIG. 2 is a longitudinal cross-sectional view showing the use of the pipe cleaner of this invention within the opening provided in the stem of a pipe.
FIG. 3 is a cross-sectional view taken along line 3—3 of FIG. 2.
FIG. 4 is a cross-sectional view showing the use of the pipe cleaner of this invention within the bowl of a pipe.

Referring particularly to the drawing, there is shown the pipe cleaner 10 of this invention which is formed of a first end 12, a second end 14, with a handle section 16 located therebetween. The ends 12 and 14 are basically similar to each other and the basic shape in cross-section of the pipe cleaner 10 is S-shaped. The handle section 16 is located so that the length of each of the ends 12 and 14 are similar. The handle section 16 is to be constructed of a rigid material, such as a plastic or the like. The ends 12 and 14 can be of any convenient length.

Also, the S-shape is preferable, but other shapes may be employed.

The sections 12 and 14 will normally be constructed of a spring steel with the property of memory, which facilitates bending into various configurations. However, the normal at rest position for the pipe cleaner 10 is in the position shown in FIG. 1.

To facilitate use of the pipe cleaner 10 within different size orifices or passageways 22 within the stem 18 of the pipe 20, each end 12 and 14 is normally tapered so that the outermost or free end of each end 12 and 14 is substantially smaller in width than at the point of connection with the handle section 16. If the passageway 22 is quite small, only a small portion of the length of the end 12 or 14 would be inserted within the passageway 22. For larger sizes of passageway 22, the end 12 or 14 is inserted a greater distance and can be inserted entirely through the passageway 22 and bent up through the bowl as shown in FIGS. 2 and 3 of the drawing. When such does occur, the edges of the ends 12 and 14 facilitates the removing of scale from the interior of the wall 22.

Referring particularly to FIGS. 2 and 3, it can be seen that the pipe cleaner is used in a substantially straight configuration to clean a substantially straight passageway 22 and will conform to curved passageways as well. If it is desired to clean the bowl 24, an end 12 or 14 can be bent with the tip of the end tucked into a slot on the handle and then placed within the bowl as shown in FIG. 4 of the drawing. The cleaner 10 is then rotated during use. The cleaning operation within FIGS. 2 and 3 would be in a reciprocating lineal motion.

What is claimed is:

1. A pipe cleaner comprising:

an elongated member constructed of a bendable rigid material said member being arcuate at an at rest position, said member having a fore end and an aft end, said fore end being substantially similar to said aft end;

a handle section attached to said member intermediate said fore end and said aft end; and when said member is at rest the said member is located in an initial elongated position for cleaning straight or curved passageways of the pipe, said member having an outermost tip, said member being bendable to assure a substantially U-shaped configuration, with said member in said U-shaped configuration the said outermost tip is engaged within a securing means in said handle to thereby maintain said member in said U-shaped position for cleaning the bowl of said pipe, upon disengagement of said outermost tip from said securing means and upon release of said member from the bending force the said member substantially returns to said initial position

2. The pipe cleaner as defined in claim 1 wherein:

each said end of said member being tapered between said handle section and said outermost end, said tapering being such that the portion of said end adjacent said handle section is wider than said outermost end of each of said member.

* * * * *